US005305598A

United States Patent [19]

Nicolaides

[11] Patent Number: 5,305,598

[45] Date of Patent: Apr. 26, 1994

[54] ENERGY GENERATED FROM VOLCANIC GROUNDSTATES

[76] Inventor: Cleanthes A. Nicolaides, 18 Agras Street, Athens, Greece, 11635

[21] Appl. No.: 780,414

[22] Filed: Oct. 22, 1991

Related U.S. Application Data

[63] Continuation of Ser. No. 369,288, Jun. 21, 1989, abandoned.

[51] Int. Cl.[5] ..... C06B 47/00; C06D 5/00

[52] U.S. Cl. ..... 60/205; 149/1; 423/262

[58] Field of Search ..... 149/1; 60/205; 423/262

[56] References Cited

U.S. PATENT DOCUMENTS

| | | | |
|---|---|---|---|
| 3,112,609 | 12/1963 | Bridgforth | 149/1 |
| 3,204,560 | 9/1965 | Gustavson | 149/1 |
| 3,278,351 | 10/1966 | Null et al. | 149/1 |
| 3,407,604 | 10/1968 | Keith et al. | 149/1 |
| 3,516,879 | 6/1970 | Paine | 149/1 |
| 3,586,550 | 6/1971 | Morana | 149/1 |
| 4,193,827 | 3/1980 | Wollam | 149/1 |
| 4,229,196 | 10/1980 | Woollam | 149/1 |
| 4,631,096 | 12/1986 | Sänger et al. | 149/1 |

*Primary Examiner*—Edward A. Miller
*Attorney, Agent, or Firm*—Robert K. Tendler

[57] ABSTRACT

A novel class of energy-generating chemical processes or reactions uses cryogenically Prepared and stored materials exhibiting volcanic ground states having lifetimes exceeding several seconds. Energy generation is provided through activation of cryogenically prepared and stored material characterized by a volcanic ground potential surface in which its lowest rotation-vibration level has a lifetime sufficiently long to permit practical storage and subsequent energy release. Cryogenic preparation and storage provides that the material is kept in these lowest rotation-vibration levels, thereby avoiding thermodynamic population of the higher levels which are short-lived and therefore not suitable for practical use. In one embodiment, the He $_2$++v=0, J=0 level has been found to have a lifetime of 220 minutes making $He_2$++an ideal candidate for a fuel in which laser-induced fragmentation of $He_2$++into He+ + He+fragments results in an energy release of 234 Kcal and a chain reaction. The resulting specific impulse reaches 1400 sec., which is about 3 times greater than that of hydrogen-oxygen fuel. Larger amounts of energy, as high as 1032 Kcal, can be produced when $He_2$++is probed with the light ground state hydrogenic species H, H−, $H_2$ and $H_2$+, with corresponding propellants having specific impulses greater than 2000 sec. Improvement of propulsive performance can be achieved via field-induced acceleration of the light ionic species which are the reaction products. Methods for production of cold $He_2$++include collisional and radiative processes.

12 Claims, 1 Drawing Sheet

ENERGY GENERATED FROM VOLCANIC GROUNDSTATES

This is a continuation of copending application Ser. No. 07/369,288 filed on Jun. 21, 1989 now abandoned.

FIELD OF THE INVENTION

This invention relates to energy storage and release, and more particularly to the use of cryogenically-stored materials having volcanic ground states as a stable fuel, propellant or rapid energy release system.

BACKGROUND OF THE INVENTION

In recent years, special interest has been devoted to the area of high energy density materials for generation of propulsive energy. In general, the quest for new fuels involves properties of matter as well as related energetic processes. Specifically for propellants, the limiting parameters of their effectiveness is stability of the fuel, followed by the amount of energy which is released upon reaction, and the mass which is involved. The best available propellants, such as the liquid hydrogen-oxygen mixture, are limited to specific impulses ($I_{sp}$) of 450–480 sec. In order to break through the current efficacy threshold of known fuels, new and practical highly energetic processes involving light atomic elements must be forthcoming. If a new class of high energy chemicals were to increase the $I_{sp}$ above 1000 sec., this would, for instance, enable a single-stage, airliner-sized vehicle to make a horizontal takeoff, convey a 25,000 lb. Payload to orbit and return for a runway landing.

Obviously, energy containing materials are those having electronic atomic and molecular excited states. However, these systems are not suitable for use as fuels due to their extreme instability, sec. and $10^{-14}$ sec. and $10^{-6}$ sec. Nonetheless, efforts are currently under way for establishing the existence of sufficiently metastable energetic excited states.

On the other hand, as will be described, it has been found that certain molecular species have a metastable ground state with a lifetime on the order of hundreds of minutes and with releasable energy, a fact which makes them eminently practical as a fuel or propellant. These species are those which have dissociating ground state surfaces that have deep energy wells which are caused by special interactions with the first excited surface which characterizes the species. The existence of a real potential energy minimum implies practical energy trapping. Once trapped, this energy can dissipate via tunneling or, occasionally, via small interactions with plunging dissociative states of a different symmetry. Such a ground state potential surface is referred to herein as a volcanic ground state.

By way of background, volcanic ground states are, of course, rarities. Two categories of diatomic or polyatomic systems having volcanic ground states have been analyzed thus far. First, as reported in the Journal of Chemical Physics, Vol. 80, p. 1900, 1984 by C. A. Nicolaides, et al., slices of hypersurfaces of a special class of polyatomic molecules show deep minima and the volcanic form along a reaction coordinate which leads to neutral ground and excited fragments. This situation emerges as a natural consequence of intramolecular charge transfer at very narrow avoided crossings whose geometric dependence is predicted by the maximum ionicity of excited state (MIES) theory.

However, calculations on clusters such as $(H_2)_2$ have thus far shown that the minima of these ground hypersurfaces are only virtual, i.e. existing for only one slice through the surface. Also, the chemically bound first excited state formed at the avoided crossing dissociates via non-adiabatic coupling within $10^{-13}$ sec. Thus, in the first category, not only are only virtual volcanic ground states exhibited, the lifetimes of corresponding excited states are much too short for the corresponding molecules to be of practical value for energy storage and release.

On the other hand, in a second category, if a volcanic ground state exists in a diatomic system, there is only one reaction coordinate and thus the minimum is always real. This being the case, at least for cryogenically-stored diatomics, if they exhibit a volcanic ground state and if the corresponding lowest rotation-vibration level has a sufficiently long lifetime, they are candidates for highly energetic practical fuels.

Note that all prior theoretical research on such diatomic and polyatomic systems has been in the chemical bonding area and has involved lifetimes which correspond to transient species observable mass spectroscopically. In this regard, the distinguishing volcanic bonding feature was first determined by Linus Pauling for the case of the $He_2^{++}\ {}^1\Sigma_g^+$ ground state. As reported in the Journal of Chemical Physics, Vol. 1, p. 56, 1933, Pauling obtained a volcanic potential energy curve which theoretically allowed tunneling and fragmentation to $He^+ + He^+$. Pauling explained this property in a valence-bond picture, in terms of covalent-ionic mixing in the wave-function and in particular of the structures He. +He. and He: +He. Furthermore, he predicted that for large R, the potential curve is defined by the 1/R Coulomb repulsion between the two $He^+$ ions and that at about 1.3Å the resonance interaction of the electrons becomes important, causing the force to become attractive at about 1.1Å. This led Pauling to the postulation of a molecule which would be sufficiently metastable to give rise to a band spectrum. Referring to the intrinsic instability of such a diatomic ground state, Pauling predicted that the four vibrational levels would show pronounced autodissociation characteristics, meaning that they would have short lifetimes. As will be seen, Pauling's qualitative predictions were correct only for the higher vibrational levels and not for the v=0 or even the v=1 levels.

Regardless, Pauling's paper signaled the beginning of a series of publications on the chemical bonding of doubly ionized diatomics. For example, further theoretical work on the bond formation and the potential energy function, V(R), of $He_2^{++}\ {}^1\Sigma_g^+$ has been published using methods which include electron correlation. A previous study by C. A. Nicolaides, et al., published in the Journal of Chemical Physics, Vol. 114, p 1, 1987, relating to the adiabatic surfaces of the ${}^2\Sigma_g^+$ Rydberg series of $He_2^+$ a calculation of the $He_2^{++}\ {}^1\Sigma_g^+$ threshold. This study also showed how the volcano form is created by the two-electron rearrangement $1\sigma_g 1\sigma_u^2 \longleftrightarrow 1\sigma_g^2 n\sigma_g$. Similarly, this study showed that the configurational mixing which determines the character of the $He_2^{++}\ {}^1\Sigma_g^+$ state is mainly $1\sigma_g^2 \longleftrightarrow 1\sigma_u^2 \longleftrightarrow 1\sigma_g n\sigma_g$. No predictions as to the lifetime of the $He_2^{++}\ {}^1\Sigma_g^+$ ground state were formed at that time, and no predictions as to the chemistry of $He_2^{++}$ were made.

As regards other doubly ionized diatomics with volcanic ground states, as reported in the Canadian Journal of Physics, Vol. 36, p. 1585, 1958, P. K. Carrol observed a spectral emission in $N_2^{++}$, while as reported in the Journal of Chemical Physics, Vol. 35, p. 575, 1961, Dorman and Morrison, at A. C. Hurley's suggestion, used the Pauling type of analysis in their discussion on the bond formation of $CO^{++}$, $N_2^{++}$ and $NO^{++}$. Since then, much theoretical and experimental work ha been published on such systems. Apart from methods of ambient temperature preparation and observation, the focus of these efforts has been on the scientific realm of molecular structure and spectroscopy with analysis analogous to those used for other molecules. As reported, the lifetimes of the vibrational levels of the studied diatomics deduced from the mass spectroscopic experiments are in the microsecond ($10^{-6}$) range. The computations of reported tunneling widths have revealed that this range corresponds to excited rovibrational levels, as opposed to ground levels. Given the conventional spectoscopic aims of the experimental research, longer lifetimes for lower levels were not studied. Indeed, D. L. Cooper simply refers to the widths of the lower levels as negligible in a report published in Chemical Physics Letters, Vol. 132, p. 377, 1986.

Moreover, except for $He_2^{++}$, for the dications whose computed potential energy curves are in the literature, it is estimated that the energy which could be released upon induced fragmentation is in the range of 3-7eV. While it would be useful to harness such energies, even if they became available, their magnitude coupled with the values of the masses of the outgoing fragments, would not lead to an impulse capacity which is competitive with the best available mono- or bi-propellant systems.

Note, the only reported observation of $He_2^{++}$ was made by M. Guilhaus et al, in the Journal of Physics, Vol. B17, L605, 1984, in which the $He_2^{++}$ was produced at ambient temperature and observed by charge-stripping mass spectroscopy. At that time, Guilhaus, et al., reported that no accurate measurement of lifetime could be made to determine whether the diatomic was stable or unstable. It is interesting to note that Guilhaus, et al., could not have discovered lifetimes of the lowest rotation-vibration level for the ground state because the set-up of their mass spectroscopic experiment was not aimed at the detection and spectroscopic analysis of states with lifetimes on the order of hundreds of minutes.

From the above scientific evidence over the years, it has been deemed unlikely for a molecular system to possess simultaneously those crucial optimal characteristics of energy, stability, mass and releasability for the realization of a practical propellant, or any practical energy storage and release system.

SUMMARY OF THE INVENTION

It is the primary finding of this invention that materials exist which exhibit volcanic ground states whose lowest rotation-vibration level exhibits an unexpectedly long lifetime, some at least ten orders of magnitude longer than corresponding excited states. When cryogenically prepared and stored, these materials provide for practical energy generation via induced fragmentation or chemical reaction with a given species. If the material has a low atomic weight and is made to react with light species, a propellant is Produced in which specific impules are more than triple those associated with conventional fuels. It is a specific finding of this invention that $He_2^{++}$ has a volcanic ground state with an inordinately long lifetime in excess of 3½ hours that permits the use of cryogenically prepared and stored $He_2^{++}$ as a stable source of positive propulsive energy. When laser activated at about 9710Å, $He_2^{++}$ produces 234 Kcal/mol through induced fragmentation into $He^+ + He^+$. The excess energy is sufficient to generate a chain reaction. This indicates that the energetics of $He_2^{++}$, together with its small mass, are unique. Activation energy of 1.28eV results in an energy release of 10.16eV, which is more than 3eV greater than the energy associated with the aforementioned double ionized diatomics. The result is a self-sustaining reaction in which an $I_{sp}$ of about 1400 sec. is achievable. The energy storage is made possible from $He_2^{++}$ production processes which include collisional or radiative mechanisms. Thus, materials having a long-lived volcanic ground state can be transformed into a useful propellant by utilizing the thrust of the ejected fragments upon induced dissociation, assuming light weight elements.

Moreover, a novel, energy-generating chemistry is established via the use of such metastable volcanic states. For example, large amounts of energy as high as 1032 Kcal can be produced when $He_2^{++}$ is probed with the light, ground state hydrogenic species of H, $H^-$, $H_2$ and $H_2^+$. Corresponding propellants have specific impulses greater than 2000 sec.

More generally, it has been found that a practical high energy density fuel or propellant is achievable from any material which has a volcanic potential energy surface if a usable lifetime for the lowest vibrational level is established. When such systems are characterized by light atomic elements, they are suitable for use as high-energy propellants.

It will be appreciated that the subject fuel is a cryogenic fuel. Were the material exhibiting the volcanic structure brought above cryogenic temperatures, it would thermodynamically establish itself in higher rovibrational levels which autodissociate rapidly thus offering no possibility for the volcanic state to be of practical use. In summary, a material exhibiting the required volcanic structure is prepared and stored at cryogenic temperatures in its lowest rotation-vibration level.

A new method of energy generation is thus proposed which comprises (1) inducing fragmentation of a cryogenically-stored material having a metastable volcanic ground state which exhibits a usable lifetime in excess of several seconds and specifically on the order of hundreds of minutes for $He_2^{++}$; or, (2) chemically reacting such a material with other species.

As another aspect of the subject invention, a method is provided for selecting material for use as a fuel in which the proposed material is analyzed to ascertain if it has a volcanic ground potential energy surface with a real well.

Having ascertained that the well is real, accurate calculations are performed to establish the lifetime of this volcanic ground state. Should the lifetime of the lowest rotation-vibration level be relatively long, this indicates that a stable fuel, propellant, or rapid energy release system is possible.

Note, the subject invention involves, in part, the generation of propulsive energy via the induced unimolecular fragmentation of a metastable cold diatomic or polyatomic system. Specifically, it has been found that cryogenically-stored $He_2^{++}$ may be used as a propellant either by itself or as part of a compound involving chemically reacting $He_2^{++}$ with a light ground state hydrogenic species. This finding is based on the aforementioned considerations and on computed special characteristics of the $He_2^{++}$ $^1\Sigma_g^+$, v=0, state. This state is metastable with an extremely long lifetime of approximately 220 minutes while at the same time its energy content is exceptionally high and easily releasable.

In summary, a novel class of energy-generating chemical processes or reactions uses cryogenically prepared and stored materials exhibiting volcanic ground states. Energy generation is provided either in a chemical reaction with or by induced fragmentation of a cryogenically-prepared and stored material characterized by a volcanic potential surface exhibiting a deep real potential well, and in which the lifetime for the lowest metastable rotation-vibration level is sufficiently long to permit practical storage and energy release. Cryogenic preparation and storage provides that the material is kept in this lowest rotation-vibration level and is not allowed to be distributed thermodynamically to higher levels which exhibit short lifetimes. In one embodiment, laser induced fragmentation of $He_2^{++}$ produces an energy release of 234 Kcal and is characterized by a specific impulse of 1400 sec. which is about 3 times greater than that of the hydrogen-oxygen fuel. Fragmentation to $He^+$ ions with a net energy gain of about 8.9eV leads to a chain reaction.

Large amounts of energy, as high as 1032 Kcal, can be produced when $He_2^{++}$ is robed with the light ground state hydrogenic species H, $H^-$, $H_2$ and $H_2^+$ which gives rise to energetic exothermic reactions. Corresponding propellants have specific impulses greater than 2000 sec. Improvement of propulsive performance can be achieved via field-induced acceleration of the light weight ionic reaction product species. It will be appreciated that conventional means are employed to direct the resulting reaction products in a predetermined direction. Methods for production of $He_2^{++}$ at liquid hydrogen temperatures include collisional and radiative processes.

BRIEF DESCRIPTION OF THE DRAWINGS

These and other features of the subject invention will be better understood in connection with the Detailed Description taken in conjunction with the Drawings of which.

DETAILED DESCRIPTION

Figure 1B:
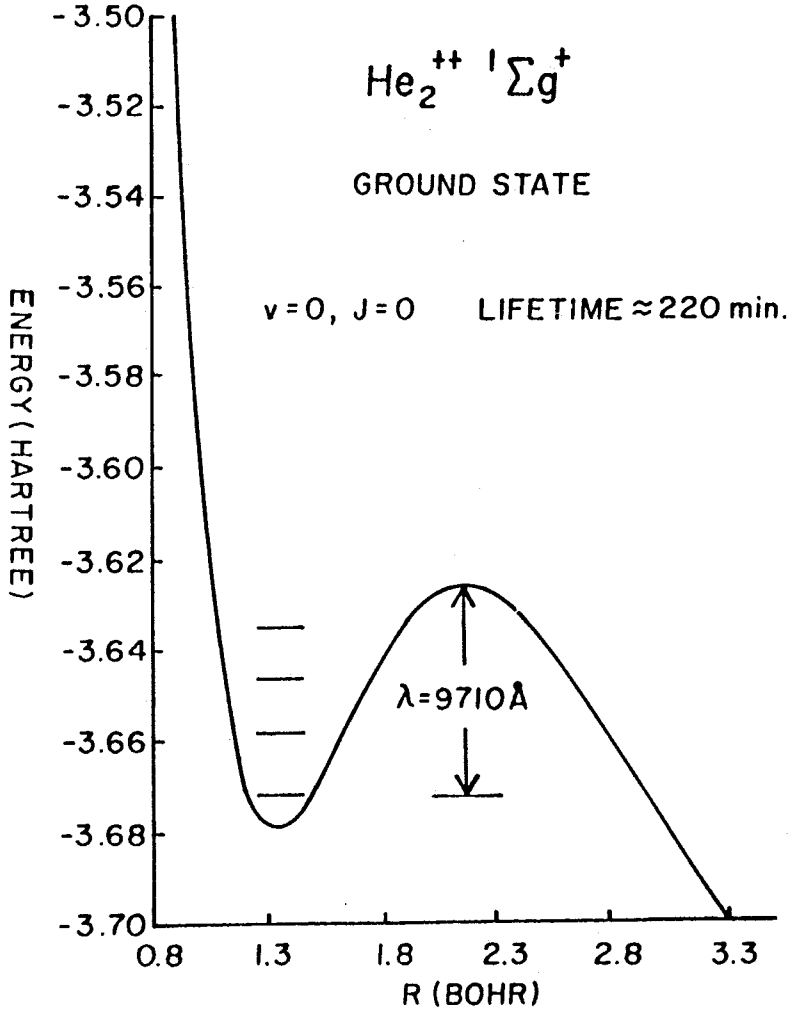
FIG. 1*a* is a graph of the potential energy surfaces for the ground and four excited states for $He_2^{++}$ $^1\Sigma_g^+$; and, FIG. 1*b* is a graph of the $He_2^{++}$ $^1\Sigma_g^+$ ground state indicating the volcanic structure, approximate activation energy and the extensive lifetime of this state.
Figure 1A:
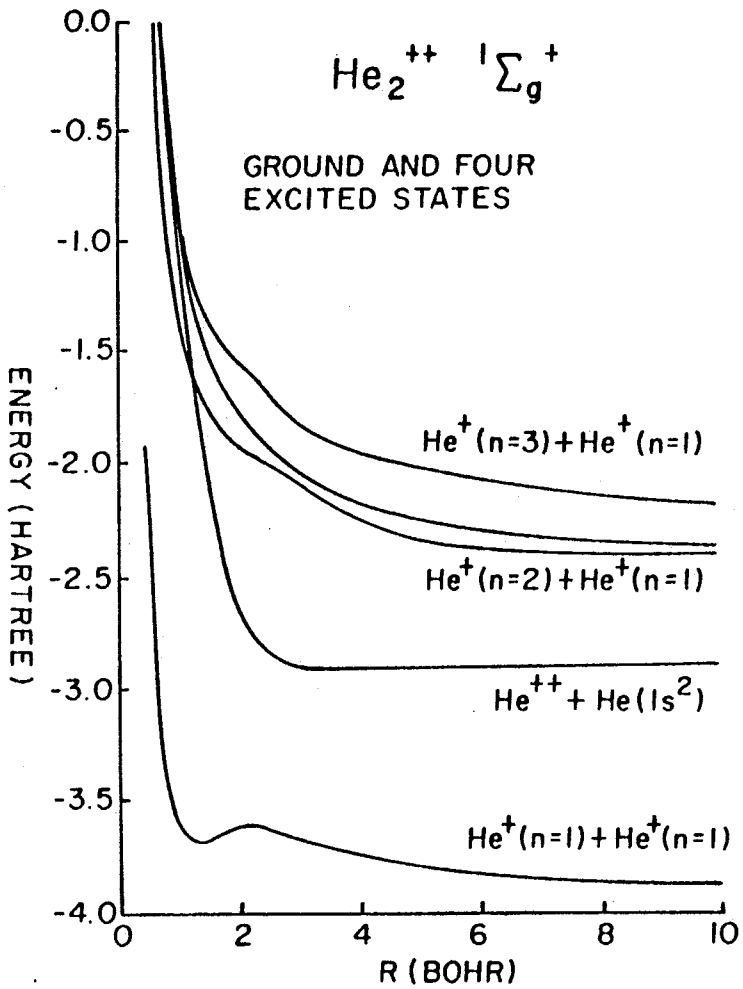

Referring now to FIG. 1*a*, potential energy surfaces of the ground state and four excited states of $He_2^{++}$ $^1\Sigma_g^+$ are shown which were obtained from a CI calculation and a very large basis set consisting of s,p,d and f functions. The volcanic character of the ground state was first explained by Pauling in terms of the covalent-ionic mixing between the ground and the first excited state. In the MO picture, the ground stage wave-function is mainly a mixture of $1\sigma_g^2$, $1\sigma_g^3$ and $1\sigma_g n\sigma_g$ configurations. On the other hand, for R<2 a.u., the first excited states shows near-diabatic avoided crossings In FIG. 1*b*, computed data for $He_2^{++}$ $^1\Sigma_g^+$ provides the potential energy surface which forms the basis for equations presented hereinafter. Note, the thermodynamic population of the (v=0, J=0,1) levels is dominant at and below liquid hydrogen temperatures.

With respect to $He_2^{++}$, after a favorable rough calculation of the Gamow tunneling factor, an accurate study of the $He_2^{++}$ $^1\Sigma_g^+$ rovibrational spectrum and its stability was performed which demonstrated unusually long and unpredicted lifetimes of hundreds of seconds, with induced energy release on the order of 10.16eV, clearly enough to both sustain the chain reaction and produce the aforementioned specific impulse of about 1400 sec.

Accurate calculation of the lifetime of $He_2^{++}$ presupposes two things. The first is a theory which is valid quantitatively for the physics of the situation and the second is a highly accurate numerical implementation. Numerical accuracy is absolutely necessary since the sought-after widths are extremely small (approximately $10^{-21}$ -$10^{-20}$ a.u.) while an uncertainty of a factor of only two or three in this range of lifetimes may decide whether the metastability is experimentally and technologically practical or not. Accurate calculation has been conducted in accordance with the equations presented below The equation which describes the physics of the autodissociation of $He_2^{++}$ for each rovibrational resonance (v,J) is $$\frac{d^2\psi_n}{dR^2} + \frac{2\mu}{\hbar^2}\left\{ W_n \cdot \left[ V(R) + \frac{J(J+1)\hbar^2}{2\mu R^2} \right] \right\}\psi_n = 0 \tag{1}$$

$$\psi(0) = 0$$

$$\psi(R) \simeq e^{i\sqrt{2w_n}\,R} \tag{1a}$$

where $\mu$-reduced mass, n=(b,J).

$W_n = E_n - i/2\Gamma_n$, is the complex eigenvalue, due to the Gamow outgoing boundary condition (1*a*).

The physical quantity of interest here is the width, $\Gamma_n$. The method of calculation constitutes an application of the advanced JWKB analyses of eq.1 by a number of researchers who tested their results o realistic model potentials. Articles describing the JWKB analysis include L. Bertocchi, et al., Nuovo Cimento, Vol. 35, p. 599, 1965; M. V. Berry, Proc. Phys. Soc., Vol. 88, p. 285, 1966; W. H. Miller, Journal of Chemical Physics, Vol. 48, p. 1651, 1968; J. N. L. Connor, Mol. Phys., Vol. 15, p. 621, 1968; and J. N. L. Connor, et al., Mol. Phys., Vol. 45, p. 149, 1982. The great advantage of the JWKB width formulae for the present application is that, while their validity is enhanced greatly due to the favorable characteristics of the $He_2^{++}$ V(R) and the fact that deep levels are involved, they lead to computational procedures which are numerically stable and do not propagate systematic errors.

More specifically, having reached the conclusion that the JWKB is intrinsically valid, expression 2, Proposed by Connor and Smith, Mol. Phys., Vol. 45, p. 149, 1982, was applied for narrow widths.

$$\Gamma_n = \frac{\hbar}{2\pi}\,\omega_n(E_n)\exp\{2\pi\alpha_n(E_n) + X_n(\beta)\} \tag{2}$$

where $\omega_n(E_n)$ is the frequency of vibration, $\alpha(E_n)$ is the phase integral for the barrier and $X_n(\beta)$ is a quantum correction which depends on the phase integral for the well, $\beta$.

The calculation of $\overline{m}$ depends on the knowledge of V(R) in analytic form over a wide range of R. Given the aim of a reliable prediction of the lifetime, in searching for the appropriate analytic V(R), not only the accuracy of the calculated energies at each $R_i$ was examined; but, also the size of the mesh and their number. Five V(R) were employed in order to test the sensitivity and the convergence of the widths. Two were published respectively by M. Yagisawa, et al., and C. A. Nicolaides, et al, the former representing the curve of lowest energy inside the well. The other three were computed at the CI level using three different, very large basis sets. The best results for V(R) were obtained with a basis set which accounts for the compactness of the charge distribution inside the well as well as for the details of the outer portion of the barrier. This set consists of 15s, 10p, 4d and 1f functions, with exponents which range from 43000 to 0.008.

The V(R) for the first five states of $^1\sigma_g^+$ symmetry are presented in FIG. 1*a*. Sixty points were computed. The equilibrium geometry of the ground state is at R=1.33 a.u. (E=−3.68058 a.u.) while the barrier top is at R=2.17 a.u. (E=−3.62655 a.u.). Using a computed v=0, J=0 energy, the activation energy $E_A$ (=E(barrier top)−E(v=0) is ~9824Å. That reported by H. Yagisawa, et al is $E_A$=9592Å. Since it is difficult to choose between the two since their difference is very small and each calculation has advantages, the average $E_A$=9710Å is adopted.

Table 1 lists the lifetimes for the $^4He_2^{++}$ and $^3He^4He^{++}$ vibrational resonances, and FIG. 1*b* contains the results pertinent hereto.

TABLE 1

| | $He_2^{++}$ $^1\Sigma_g^+$ | |
|---|---|---|
| v | ΔE(in eV) | T(in sec) |
| 0 | 0.208 | $1.33 \times 10^4$ ($3.6 \times 10^2$) |
| 1 | 0.375 | $2.69 \times 10^{-2}$ ($8.6 \times 10^{-4}$) |
| 2 | 0.345 | $4.03 \times 10^{-7}$ ($1.7 \times 10^{-8}$) |
| 3 | 0.307 | $3.46 \times 10^{-11}$ ($2.5 \times 10^{-12}$) |

This table shows lifetimes ($\tau$) and energy differences (ΔE) between consecutive vibrational levels (J=0), of the $^4He_2^{++}{}^1\Sigma_g^+$ state (and in parentheses of $^3He$ $^4He^{++}$) which decay via autodissociation to $He^+ + He^+$. Eq.2 with a very accurate potential curve has been applied. For J=0, 1, 2, the J-dependence of the widths is small and decreases with increasing v. For v=0, (J=1) $1.22 \times 10^4$ sec, (J=2)=$1.01 \times 10^4$ sec.

The activation energy is about 1.26eV while from the barrier top to the free $He^+ + He^+$, the energy released is a considerable 10.16 eV. In other words, the net energy gain from the induced fragmentation of a cold $He_2^{++}{}^1\Sigma_g^+$ is 8.9eV. Thus, the combination of the extreme stability with the high energy content of this state, leads to the conclusion that, at the molecular level, the physicochemical exoergic process $$He_2^{++}(^1\Sigma_g^+, v = 0,) \xrightarrow{h\nu = 9710\ A} He^+ + He^+ + 234 \frac{Kcal}{mol} \quad (3)$$

which can be ignited by a laser and proceeds via a chain reaction, can compete favorably with all known highly exoergic chemical combustion reactions. In particular, were this material to be usable for propulsion, its specific impulse (i the thrust delivered for each pound per second of propellant expended) would be about 3 times greater than that of the known hydrogen-oxygen fuel.

Thus the unimolecular fragmentation induced by laser or other beams can be ignited by a $CO_2$ laser and proceeds as a chain reaction.

As to chemical reactions with light species, large amounts of energy can be produced when $He_2^{++}$ undergoes charge transfer reactions. The same holds for other long-lived dications. In particular, probing $He_2^{++}$ with the light, ground state hydrogenic species H, $H^-$, $H_2$ and $H_2^+$ gives rise to the following exothermic reactions:

TABLE 2

| | |
|---|---|
| $He_2^{++} + H \rightarrow HeH^+ + He^+ +$ 481 Kcal | (4) |
| $\rightarrow He_2^{++} + H^+ +$ 508 Kcal | (5) |
| $+ H^- \rightarrow He_2^+ + H +$ 804 Kcal | (6) |
| $\rightarrow HeH^+ + He +$ 1032 Kcal | (7) |
| $+ H_2^+ \rightarrow HeH^+ + He^+ + H^+ +$ 418 Kcal | (8) |
| $\rightarrow He_2^+ + 2H^+ +$ 444 Kcal | (9) |
| $+ H_2^+ + e \rightarrow 2HeH^+ +$ 1012 Kcal | (10) |
| $+ H_2 \rightarrow He_2^+ + H_2^+ +$ 463 Kcal | (11) |
| $\rightarrow 2HeH^+ +$ 656 Kcal | (12) |

Here the total energy corresponds to the potential energy minima.

The heat generated by the reactions (3)-(12) is exceptionally high. For reasons of comparison, note that at 25° C., the well-known gas reaction $H_2 + \frac{1}{2}O_2 \rightarrow H_2O$ is exothermic by 58 Kcal/mol. When these energies are converted into thrust delivered for each pound per second of propellant expended, it can be seen that the $I_{sp}$ for reactions (3)-(12) are more than three times that of the currently used liquid hydrogen-oxygen fuel. Furthermore, given the fact that the reaction products are light ionic species, significant improvement of the propulsive performance can be achieved via field-induced acceleration.

As mentioned, the first and only observation of $He_2^{++}$ has been reported by Guilhaus et al., who employed charge-stripping mass spectrometry in a non-cryogenic process. Within a cryogenic context, there are other production mechanisms which are possible, involving radiative or collisional processes. These are as follows:

As to radiative production, it can be shown that the adiabatic ionization energy for the $He_1^+ 1\sigma_g^2 1\sigma_u^2 \Sigma_u^+ \rightarrow He_2^{++}{}^1\Sigma_g^+$ transition is 35.6eV. The $^1\Sigma_g^+$ state can also be reached via photon emission from the first excited $^1\Sigma_u^+$ state. The cross-section for such a process to occur during slow collisions of He with $He^{++}$ has been calculated by Cohen and Bardsley, Physical Review, Vol. A18, p. 1004, 1978.

As to collisional processes, in the early sixties, it was established that the slow collisions of $He + He^+$ proceed diabatically, as a pseudo-crossing of the configuration $1\sigma_g 1\sigma_u^2\ ^2\Sigma_g^+$ through the $1\sigma_g^2 2\sigma_g$ state. Present CI calculations on the $He_2^+\ ^2\Sigma_g^+$ states show that the correlated $1\sigma_g 1\sigma_u^2\ ^2\Sigma_g^+$ indeed (pseudo) crosses the whole $1\sigma_g^2 n\sigma_g$ Rydberg series and enters the continuum $He_2^{++} + e$ at about R=1.1 a.u. This fact implies that, under controlled $He + He^+$ collision conditions, it is possible to create $He_2^{++}$ and electrons. Furthermore, a similar condition occurs with the $1\sigma_g 1\sigma_u 2\sigma_g^2 \Sigma_u^+$ configuration, which crosses the $1\sigma_g^2 n\sigma_u^2 \Sigma_u^+$ Rydberg series and enters the continuum at larger values of R. Thus, generation of $He_2^{++}$ also possible via slow $He^+ + He^*$ ($1s2s^3S$) collisions.

Whatever the mechanism of $He_2^{++}$ production, the desideratum is the optimization of efficient pathways to the v=0 level. In thermodynamic equilibrium, the population of the J=0,1 levels is dominant at and below liquid hydrogen temperatures.

Due to its unique stability, energy content and small mass, the $He_2^{++}\,{}^1\Sigma_g^+$ (B=0) state constitutes an excellent quantum system for the storage and release of propulsive energy. A few energy-generating physical and chemical reactions are given by egs. (3)-(12), whose essence is applicable to all volcanic ground states. The specific impulses corresponding to these reactions exceed by far the current capabilities of all the known propellants. Thus, it has been found that the synthesis of cold $He_2^{++2}\,\Sigma_g^+$ is possible, while its isolation and spacial confinement is achievable via the application of external electromagnetic fields.

The program for the calculations of lifetimes according to eg. 2 is as follows:

Calculation of Lifetime (eg. 2)

```
$BATCH
C     THIS PROGRAM CALCULATES THE VIBRATIONAL LEVELS OF ONE-D POTENTIAL
C     EMULATED BY SPLINES ACCORDING TO PROGRAM FITLOS (ARISTOPHANES).
C     THE METHOD USED IS THE MILLER'S EXTENDED WKB APPROXIMATION FOR
C     POTENTIALS WHICH EXHIBIT A TUNNELING BEHAVIOUR.
C     ACCORDING TO THE METHOD THE ACTION INTEGRAL OVER THE INNER
C     CLASSICALY
C     ALLOWED REGION WHICH EQUALS (N+½)*PI, CORRESPONDS TO THE EXPECT
C     VIBRATIONAL LEVEL. IN ORDER THIS ENERGY TO BE CALCULATED
C     THE PROGRAM FINDS THE EXACT TURNING POINTS FOR TWO GUESSED ENERGY
C     AND FOR TWO GUESSED POSITION-VALUES. BY USING THE NEWTON-RAPHSON
C     ITERATIVE METHOD, PROVIDED THAT THE WANTED ROOT LIES BETWEEN
C     THE TWO GUESS ENERGIES. THEN, AN ITERATIVE PROCESS BEGINS BY USE
C     THE BISECTION METHOD, WHICH LEADS TO THE RESONANCE POSITION.
C
C     THEN, FOR THE ALREADY SPECIFIED LEVEL, THE ACTION INTEGTRAL
C     THROUGH THE BARRIER IS CALCULATED AND THE WIDTH OF THIS LEVEL IS
C     EVALUATED.
C
C     THIS PROGRAM INCLUDES ALSO OPTION FOR CONNOR-CORRECTIONS.
C                         CORRECTIONS OF CONNOR
            IMPLICIT REAL*Σ(A-H,O-Z)
            COMPLEX*16 CDGAMMA,Z,ZZ
            COMMON/NUM/AM,TOL,PI,NQ,IDEC1
            COMMON/INTGRL/F1,TH
            COMMON/SPLN/XM(20),C(20,10),XHO,NS,NM,JJ
            IREAD=8
            OPEN(IREAD,FORM='UNFORMATTED')
            REWIND IREAD
C
C     HS=NUMBER OF SEGMENTS
C     HM=DEGREE OF THE POLYNOMIAL
C
            READ(IREAD) HS,HM,(XM(J),J=1,NS),XMO,XFIN
            N=HM*1
            READ(IREAD)((C(J,I),I=1,4),J=1,NS)
            WRITE(6,77) XMO,(XM(J),J=1,HS)
      77    FORMAT(7F10.6)
            00 1 J=1,HS
            WRITE(6,78) (C(J,I),I=1,H)
      |     CONTINUE
      78    FORMAT(3021.11)
C
            AM=3647.571D0
C           AM=3134.608D0
C           AM=13610.19449D0
            DE =1.0-70
            TOL=1.0-08
            PI=4.00*DATAH(1.D0)
      66    CONTINUE
            WRITE(6,7)
      7     FORMAT(' CORRECTIONS NEAR THE TOP (Y/N): 1/0')
            READ(5.13) IDEC1
            WRITE(6,8)
      8     FORMAT(' CORRECTIONS NEAR THE BOTTOM (Y/N): 1/0')
            READ(5.13) IDEC2
            WRITE(6.12)
      12    FORMAT(' GUESSES: X1 / X2 / X3 / X4 / EMIN / EMAX / H / J')
            READ(5.11) X1,X2,X3,X4,E1,E2
            READ(5.13) No,JJ
      --11  FORMAT(F10.0)
      13    FORMAT (11)
            CALL NR1(Y1,E1,X1,X2,X3,X4)
            CALL NR1(Y2,E2,X1,X2,X3,X4)--
            IF (Y1*Y2 .GT. 0.D0) GOTO 66
      200   CONTINUE
            A=E1
            B=E2
```

-continued

Calculation of Lifetime (eg. 2)

```
      X=(A+B)/2.00
      CALL NRI(Y1,A.X1,X2,X3,X4)
      CALL NRI(Y,X,X1,X2,X3,X4)
      IF(Y1*Y .LE. 0.D0) THEN
      E1=A
      E2=X
      ELSE
      E1=X
      E2=B
      ENDIF
C--
      WRITE(6,22) X,Y
C--
      IF(DABS(Y) .GE. TOL) GOTO 200
22    FORMAT(' ENERGY=',F12.7,' TEST:',F12.8)
C
C     CALCULATION OF THE WIDTH (CORRECTIONS INCLUDED)
C
      CALL HRI(0,X,X1,X2,X3,X4)
      FIR=FI
      THR=TH
      WRITE(6,128)FIR,THR
128   FORMAT(' INTEGRALS AT RESONANCE ',2020.10)
C
      E1=X-DE
      CALL NRI(0.E1.X1,X2,X3,X4)
      W1=(FIR-FI)/DE
      TH1=TH
      E2=X+DE
      CALL HRI(0.E2,X1.X2,X3,X4)
      W2=(FI-FIR)/DE
      TH2=TH
      DER=(W1+W2)/2.00
      ON=PI/DER
      WRITE(6.23) DER.OH
23    FORMAT(' DF/DE AT RESONANCE',020.10,' FREQUENCY (A.U)',D2
C
      CHI=0.D0
      IF(IDEC2 .EQ. 0) GOTO 350
      EL=DFLOAT(HO)+0.5D0
      Z=CMPLX(0.5D0+EL)
      ZZ=CDGAMMA(Z)
      ZR=DREAL(ZZ)
      ZI=DIMAG(ZZ)
      WRITE(6,*) ZR,ZI
      CHI=EL*DLOG(EL)-EL+DLOG(2.D0*PI)/2.D0-DLOG(ZR)
350   CONTINUE
      SS=1.D0+DEXP(-2.D0*THR+CHI)
      SC=DLOG(SS)
      SM=DSQRT(SS)
      WCON=SC/4.D0
      WMIL=(SM-1.D0)/(SM+1.D0)
      WMZ=DEXP(-2.D0*THR+CHI)/4.D0
      WRITE(6.67) WCON.WMIL,WMZ
      WCON=WCON/DER
      WMIL=WMIL/DER
      WMZ=WMZ/DER
      WRITE(6,68) WCON.WMIL,WMZ
67    FORMAT(' W(TH) (A.U) ',3D20.10)
68    FORMAT(' HALF WIDTH (A.U) ',3D20.10)
      WMIL=WMIL/DER
      WMZ=WMZ/DER
      WRITE(6.68) WCON,WMIL,WM2
67    FORMAT(' W(TH) (A.U) ',3D20.10)
68    FORMAT(' HALF WIDTH (A.U) ',3D20.10)
      STOP
      END
C     ------------------------------
      SUBROUTINE NRI(F,E0,X1,X2,X3,X4)
C     ------------------------------
      IMPLICIT REAL*8(A-H.O-Z)
      COMPLEX*16 CDGAMMA.Z.ZZ
      COMMON/NUM/AM.TOL.PI.NQ.IDEC1
      COMMON/IHTGRL/FI,TH
      DIMENSION AK(10000), IX(4).XXX(4)
C     NUMBER OF INTERVALS AND POINTS FOR 5-POINT INTEGRATION TECHNIQUE
C     ---------
      NDX=4*500
      NPTS=HDX+1
C     ---------
      N=500
```

-continued

Calculation of Lifetime (eg. 2)

```
      XXX(1)=X1
      XXX(2)=X2
      XXX(3)=X3
      XXX(4)=X4
C
C     NEWTON RAPHSON TECHNIQUE
C
      DO 30 IFLAG=1,2
      X=XXX(IFLAG)
      DO 20 I=1,H
      Y=X
      X=X-(V(X)-EO)/DV(X)
      IF(DABS(X-Y) .LT. TOL) GOTO 55
20    CONTINUE
      STOP
55    CONTINUE
      XXX(IFLAG)=X
      WRITE(6,33) IFLAG,X
30    CONTINUE
33    FORMAT(' X',I1,F12.8)
C
C     5-POINT INTEGRATION TECHNIQUE
      STEP=(XXX(2)-XXX(1))/DFLOAT(HDX)
      IX(1)=XXX(1)/STEP
      IX(2)=XXX(2)/STEP
      WRITE(6,*) IX(1),IX(2)
      DO 40 I=1,NPTS
      X=STEP*DFLOAT(I+IX(1)-1)
40    AK(I)=DSQRT(2.D0*AM*DABS((EO-Y(X))))
      SUM=0.D0
      DO 177 I=1,NPTS,4
      SUM=SUM+7.D0*AK(I)+32.D0*AK(I+1)+12.D0*AK(I+2)
1     +32.D0*AK(I+3)+7.D0*AK(I+4)
177   CONTINUE
      F1=2.D0/45.D0*STEP*SUM
C
C     NEWTON RAPHSON TECHNIQUE
C
      DO 31 IFLAG=3,4
      X=XXX(IFLAG)
      DO 21 I=1,N
      Y=X
      X=X-(V(X)-EO)/DV(X)
      IF(DABS(X-Y) .LT. TOL) GOTO 56
21    CONTINUE
      STOP
56    CONTINUE
      XXX(IFLAG)=X
      WRITE(6,33) IFLAG,X
31    CONTINUE
C
C     5-POINT INTEGRATION TECHNIQUE
      IX(3)=XXX(3)/STEP
      IX(4)=XXX(4)/STEP
      WRITE(6,*) IX(3),IX(4)
      DO 41 I=1,NPTS
      X=STEP*DFLOAT(I+IX(3)-1
41    AK(I)=DSQRT(2.D0*AM*DABS((EO-Y(X))))
      SUM=0.D0
      DO 178 I=1,NPTS,4
      SUM=SUM+7.D0*AK(I)+32.D0*AK(I+1)+12.D0*AK(I+2)
1     +32.D0*AK(I+3)+7.D0*AK(I+4)
178   CONTINUE
      F2=2.D0/45.D0*STEP*SUM
      FF=0.D0
C     CORRECTIONS (Y/N): IDEC1=1/O
      IF(IDEC1 .EQ. 0) GOTO 333
      EL=1.D0/PI*F2
      2=CMPLX(0.5D0. EL)
      ZZ=CDGAMMA(Z)
      GR=DREAL(ZZ)
      GI=DINAG(ZZ)
      ARG=DATAN2(GI.GR)
      FF=EL+ARG-EL*DLOG(DABS(EL))
333   CONTINUE
      F=F1+FF/2.D0-(DFLOAT(NO)+0.5D0)*PI
C
      CALL ZERO(AK.10000)
      CALL ZERO(XXX.4)
      CALL IZERO(IX.4)
      FI=F1
```

-continued

Calculation of Lifetime (eg. 2)

```
          TH=F2
          RETURN
          END
C         ------------------
          SUBROUTINE ZERO(A.H)
C         ------------------
          REAL *8 A(1)
          DO 11 I=1,H
    11    A(I) =0.0D0
          RETURN
          END
C         ------------------
          SUBROUTINE IZERO(K,H)
C         ------------------
          DIMENSION K(H)
          D0 11 I=1,H
    11    K(I) =0
          RETURN
          END
C         ----------------------------
          DOUBLE PRECISION FUNCTION V/X)
C         ----------------------------
          IMPLICIT REAL*8(A-H,O-Z)
          COMMON/NUM/AM.TOL.PI.NQ.IDEC1
          COMMON/SPLN/XM(20),C(20,10),XMO,HS.HM,JJ
C
C   CHOICE OF THE SEGMENT WHICH CORRESPONDS TO X
C
          IF(X .GE. XMO .AND. X .LT. XM(1)) J=1
          DO 1 I=1,HS-1
          IF(X .GE. XM(I) .AND. X .LT. XM(I+1)) J=I+1
    1     CONTINUE
C
          VO=0.D0
          N=NM+1
          VO=0.D0
          N=NM+1
          DO 2 I=1,N
    2     VO=VO+C(J.I)*X**(I-1)
          AJ1=DFLOAT(JJ)*DFLOAT(JJ*1)
          AJ2=(DFLOAT(JJ)+0.5D0)*(DFLOAT(JJ)+0.5D0)
          VJ1=AJ1/2.D0/AM/X/X
          VJ2=AJ2/2.D0/AM/X/X
          VJ=VJ1
          V=VO+VJ
          RETURN
          END
C         ----------------------------
          DOUBLE PRECISION FUNCTION DV/(X)
C         ----------------------------
          IMPLICIT REAL*8(A-H.O-Z)
          COMMON/NUM/AM.TOL.PI.NQ.IDEC1
          COMMON/SPLN/XM(20),C(20,10),XMO,HS.HM,JJ
C
C   CHOICE OF THE SEGMENT WHICH CORRESPONDS TO X
C
          IF(X .GE. XMO .AND. X .LT. XM(1)) J=1
          DO 1 I=1,NS-1
          IF(X .GE. XM(I) .AND. X .LT. XM(I+1)) J=I+1
    1     CONTINUE
C
          DVO=0.D0
          N=NM+1
          DO 2 I=2.H
    2     DVO=DVO+C(J,I)*DFLOAT(I-1)*X**(I-2)
          AJ1=DFLOAT(JJ)*DFLOAT(JJ+1)
          AJ2=(DFLOAT(JJ)+0.5D0)*(DFLOAT(JJ)+0.5D0)
          VJ1=-AJ1/AM/X/X/X
          VJ2=-AJ2/AM/X/X/X
          DVJ=VJ1
          DV=DVO+DVJ
          RETURN
          END
C         ----------------------------
          COMPLEX*16 FUNCTION CDGAMMA(Z)
C         ----------------------------
          IMPLICIT REAL*8(A-H.O-Z)
          COMPLEX*16 Z.U.V.H,S
          DIMENSION G(16)
          DATA PI /3.14159 26535 89793/
          DATA G
```

-continued

Calculation of Lifetime (eg. 2)

```
        1/41.62443 69164 39068.-51.22424 10223 74774,+11.33875 58134 88
        2 -0.74773 26877 72388, +0.00878 28774 93061, -0.00000 18990 30
        3 +0.00000 00019 46335, -0.00000 00001 99345, +0.00000 00000 08
        4 +0.00000 00000 01486, -0.00000 00000 00806, +0.00000 00000 00
        5 -0.00000 00000 00102, +0.00000 00000 00037, -0.00000 00000 00
        6 +0.00000 00000 00006/
        U=Z
        X=DREAL(U)
        IF(X .GE. 1.D0) GO TO 3
        IF(X .GE. .0D0) GO TO 2
        V=1.D0-U
        L=1
        GO TO 11
    2   V=U+1.D0
        L=2
        GO TO 11
    3   V=U
        L=3
   11   H=1.D0
        8=G(1)
        DO 1 K = 2,16
        FK=K-2
        S=G(1)
        DO 1 K = 2,16
        FK=K-2
        FK1=FK+1.DO
        H=((Y-FK1)/(V+FK))*H
    1   S=S+G(K)*H
        H=V+4.5D0
        CDGAMMA=2.506628274631001D0*CDEXP((V-0.5)*CDLOG(H)-H)*S
        GO TO (21,22,23), L
   21   CDGAMMA=PI/(CDSIN(PI*U)*CDGAMMA)
        RETURN
   22   CDGAMMA=CDGAMMA/U
   23   RETURN
        END.
$BEND
```

Having above indicated a preferred embodiment of the present invention, it will occur to those skilled in the art that modifications and alternatives can be practiced within the spirit of the invention. It is accordingly intended to define the scope of the invention only as indicated in the following claims:

I claim:

1. A method of providing a high specific impulse propellant comprising:

cryogenically forming and storing a material having a volcanic ground state; and supplying activation energy to the material in a reaction chamber ,whereby said material forms reaction products, providing said high specific impulse (Isp).

2. The method of claim 1 wherein said material is $He_2^{++}$, whereby the $I_{sp}$ exceeds 1000 sec.

3. A cryogenic propellant having a metastable ground state, an $I_{sp}$ of greater level than 1000 sec. and a lifetime for its lowest rotation-vibration level greater than a few seconds.

4. The propellant of claim 3 wherein said propellant is a material having a volcanic ground state and a metastable rotation-vibration level.

5. The propellant of claim 4 wherein said material is ionized.

6. The propellant of claim 5 wherein said material is doubly ionized.

7. The propellant of claim 6 wherein said material is $He_2^{++}$ having a $^1\Sigma_g^+$, v=0, ground state exhibiting a volcanic form.

8. The propellant of claim 3 wherein said propellant is stored at liquid hydrogen temperature or below.

9. A cryogenic fuel having a metastable ground state which has a lifetime in excess of a few seconds and which gives off energy in a chain reaction process via induced fragmentation of an ionized material having a volcanic structure for the potential surface associated with its lowest rotation-vibration level, whereby a portion of the energy given off in the fragmentation is used to sustain the chain reaction.

10. The fuel of claim 9 wherein said material is $He_2^{++}$.

11. A method of generating energy comprising the steps of:

cryogenically storing $He_2^{++}$; and inducing fragmentation of the stored $He_2^{++}$, thereby to release energy and $He^+$ ions.

12. The method of claim 11 wherein said fragmentation inducing step includes irradiating said stored $He_2^{++}$ with $CO_2$ laser light.

* * * * *